US008534104B2

(12) United States Patent
Shimura et al.

(10) Patent No.: US 8,534,104 B2
(45) Date of Patent: Sep. 17, 2013

(54) PORTABLE WIRELESS KEY

(75) Inventors: Tokio Shimura, Anjo (JP); Mitsuru Nakagawa, Chiryu (JP)

(73) Assignee: Denso Corporation, Kariya (JP)

( * ) Notice: Subject to any disclaimer, the term of this patent is extended or adjusted under 35 U.S.C. 154(b) by 94 days.

(21) Appl. No.: 13/136,416

(22) Filed: Aug. 1, 2011

(65) Prior Publication Data

US 2012/0031155 A1 Feb. 9, 2012

(30) Foreign Application Priority Data

Aug. 2, 2010 (JP) ..... 2010-173445

(51) Int. Cl.
*E05B 19/00* (2006.01)

(52) U.S. Cl.
USPC ..... 70/456 R; 70/252; 70/408

(58) Field of Classification Search
USPC ..... 70/252, 408, 456 R, 459
See application file for complete search history.

(56) References Cited

U.S. PATENT DOCUMENTS

| | | | | |
|---|---|---|---|---|
| 1,885,957 | A * | 11/1932 | Singleton | 70/456 R |
| 5,215,190 | A * | 6/1993 | Hoffpauir, Jr. | 70/456 R |
| 6,460,386 | B1 * | 10/2002 | Watanuki et al. | 70/456 R |
| 6,553,802 | B1 * | 4/2003 | Jacob | 70/456 R |
| 7,448,238 | B2 * | 11/2008 | Shimura et al. | 70/456 R |
| 7,634,932 | B2 * | 12/2009 | Cadiz et al. | 70/456 R |
| 7,690,233 | B2 * | 4/2010 | Katagiri et al. | 70/456 R |
| 7,726,161 | B2 * | 6/2010 | Canard et al. | 70/456 R |
| 2004/0237613 | A1 * | 12/2004 | Shimura et al. | 70/456 R |
| 2005/0166650 | A1 | 8/2005 | Shimura et al. | |
| 2006/0010944 | A1 | 1/2006 | Balko et al. | |
| 2007/0137271 | A1 * | 6/2007 | Katagiri et al. | 70/459 |
| 2007/0266748 | A1 | 11/2007 | Fitz et al. | |

FOREIGN PATENT DOCUMENTS

| | | |
|---|---|---|
| JP | 2001-40921 | 2/2001 |
| JP | 2007-107348 | 4/2007 |
| JP | 2007-514079 | 5/2007 |
| JP | 2008-8032 | 1/2008 |
| JP | 2008-28913 | 2/2008 |

OTHER PUBLICATIONS

Office Action dated Jul. 18, 2012 in corresponding Japanese Application No. 2010-173445 with English translation.

* cited by examiner

*Primary Examiner* — Christopher Boswell
(74) *Attorney, Agent, or Firm* — Harness, Dickey & Pierce, PLC

(57) ABSTRACT

A portable wireless key having an emergency key includes a body in which the emergency key is held. The body has an operation surface and a protrusion action portion. The operation surface defines a part of an outer side surface of the body. The protrusion action portion has a hook that is held in the body under a condition that the emergency key is held in the body. One push to the operation surface causes the protrusion action portion to perform a protrusion action. The protrusion action causes the protrusion action portion to protrude outward from the body in such a manner that the hook of the protrusion action portion is exposed outside the body.

20 Claims, 5 Drawing Sheets

PORTABLE WIRELESS KEY

CROSS REFERENCE TO RELATED APPLICATION

This application is based on and claims priority to Japanese Patent Application No. 2010-173445 filed on Aug. 2, 2010, the contents of which are incorporated herein by reference.

TECHNICAL FIELD

The present invention relates to potable wireless keys for locking/unlocking a door of a vehicle by wirelessly communicating with the vehicle, in particular, a portable wireless key having a wireless key body in which an emergency key as a mechanical key for locking/unlocking the door is inserted and held.

BACKGROUND

In recent years, there has been an increase in the number of vehicles equipped with an electronic key system such as a keyless entry system, a smart entry system, or a smart start system. As described in, for example, JP-A-2001-40921, such an electronic key system includes a portable wireless key for performing wireless communication with a vehicle. In case that a battery of the key is exhausted and that a battery of the vehicle is exhausted, the portable wireless key is generally provided with an emergency key.

In the emergency key, an end portion of a key plate portion has a grip portion, and the grip portion has a ring portion. Generally, the emergency key is held in a body of the portable wireless key in such a manner that the ring portion can be used.

When the portable wireless key is left in a hotel (so that a staff of the hotel can drive the vehicle to a parking lot), the emergency key is generally removed from the body before the portable wireless key is left. As a result, the body of the portable wireless key does not have the ring portion. Therefore, the hotel cannot use the ring portion to store and keep the portable wireless key.

Generally, a key ring is attached to the ring portion of the emergency key to keep the emergency key and other keys together. In such a case, the ring portion may be unavailable, even when the ring portion is wanted to be used at home or the like to hang the emergency key on a hook, for example.

It may be considered that a catch portion such as a projection is formed to the body. However, the projection may be caught when the portable wireless key is carried in a pocket. Further, the projection may spoil the design of the portable wireless key.

SUMMARY

In view of the above, it is an object of the present invention to provide a convenient-to-use portable wireless key having a hook that can be used to keep the portable wireless key. The hook is formed at a portion other than an emergency key without spoiling a design of the portable wireless key.

According to an aspect of the present invention, a portable wireless key for locking/unlocking a door of a vehicle by wirelessly communicating with the vehicle includes a body. An emergency key as a mechanical key for locking/unlocking the door is inserted and held in the body. The body has an operation surface and a protrusion action portion. The operation surface defines a part of an outer side surface of the body. The protrusion action portion has a hook that is held in the body under a condition that the emergency key is held in the body. One push to the operation surface causes the protrusion action portion to perform a protrusion action. The protrusion action causes the protrusion action portion to protrude outward from the body in such a manner that the hook of the protrusion action portion is exposed outside the body.

Since the protrusion action portion having the hook is held inside the key body, the hook can be exposed outside and used whenever the hook becomes necessary. Further, since the hook can be held inside whenever the hook becomes unnecessary, a design of the portable wireless key is not spoiled. Furthermore, since the hook can be exposed outside by one push, a user can easily expose the hook outside.

BRIEF DESCRIPTION OF THE DRAWINGS

The above and other objects, features, and advantages will become more apparent from the following description and drawings in which like reference numerals depict like elements. In the drawings.

DETAILED DESCRIPTION OF THE PREFERRED EMBODIMENTS

First Embodiment

A portable wireless key 1 according a first embodiment of the present invention is used for an electronic key system such as a keyless entry system, a smart entry system, or a smart start system of a vehicle, for example. The portable wireless key 1 wirelessly communicates with the vehicle to lock/unlock a door of the vehicle. In the electronic key system, the vehicle wirelessly outputs a polling radio wave in a predetermined key search area, and the portable wireless key 1 is searched in the search area based on wireless reception of a response signal. Then, the vehicle is controlled in a predetermined manner based on an ID code that is wirelessly received from the portable wireless key 1.

According to the first embodiment, the portable wireless key 1 is configured as a so-called smart key for the smart entry system and the smart start system of the vehicle. In the smart entry system, when the portable wireless key 1 is located in a predetermined key search area outside the vehicle, an ID code is wirelessly returned from the portable wireless key 1 and checked. Then, a permission to unlock the door is given based on the check result. Then, when a predetermined unlock operation is detected under a condition that the permission to unlock the door is given, a door lock mechanism is activated to unlock the door. That is, a switching between a unlock permission condition and a unlock prohibition condition is performed based on the check result. In the unlock permission condition, the door can be unlocked by the predetermined unlock operation. In the unlock prohibition condition, the door cannot be unlocked.

In the smart start system, when the portable wireless key 1 is located in a predetermined key search area inside the vehicle, an ID code is wirelessly returned from the portable wireless key 1 and checked. Then, a permission to start an engine is given based on the check result. Then, when a predetermined engine start operation is detected under a condition that the permission to start the engine is given, the engine is started. That is, a switching between a start permission condition and a start prohibition condition is performed based on the check result. In the start permission condition, the engine can be started by the predetermined engine start operation. In the start prohibition condition, the engine cannot be started.

Figure 1:
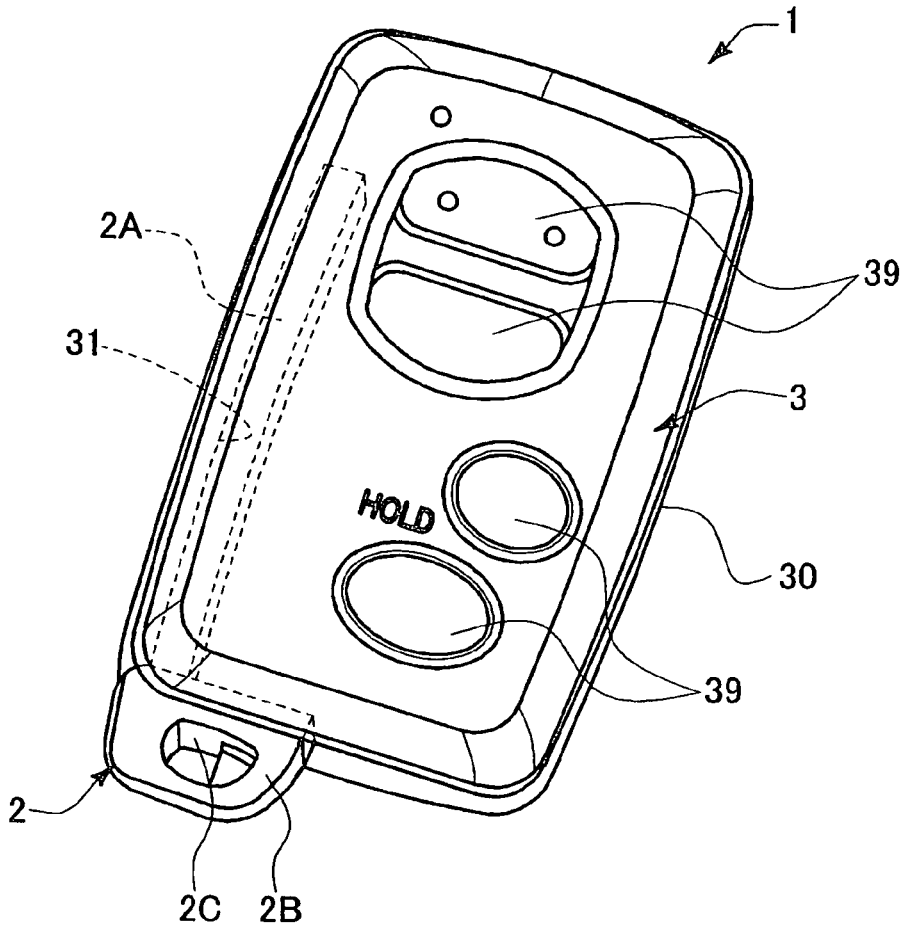
FIG. 1 is a diagram illustrating an outside view of a portable wireless key according to a first embodiment of the present invention.

FIG. 1 is an outside view of the portable wireless key 1 according to the present embodiment. The portable wireless key 1 includes an emergency key 2 and a wireless key body 3 for holding the emergency key 2. The emergency key 2 is a mechanical key for directly locking/unlocking the door of the vehicle through a key slot of the door. The emergency key 2 is inserted and held in an accommodation space 31 of the wireless key body 3.

The emergency key 2 includes a key plate portion 2A and a key grip portion 2B. The key plate portion 2A is to be inserted in the key slot of the vehicle. The grip portion 2B is located at an end of the key plate portion 2A. The grip portion 2B has a ring portion 2C as a first hook. The ring portion 2C is located outside the wireless key body 3 under a condition that the key plate portion 2A is held in the accommodation space 31. Specifically, the emergency key 2 is held in the wireless key body 3 in such a manner that the grip portion 2B projects from an outer side surface 30 of the wireless key body 3.

The wireless key body 3 is shaped like a box with a smooth contour. Specifically, the wireless key body 3 has a substantially cube shape with chamfered corners. The accommodation space 31 for the emergency key 2 extends from an end of the short side along the long side of the wireless key body 3. The emergency key 2 is held in the wireless key body 3 by inserting the key plate portion 2A in the accommodation space 31 in a length direction of the long side. The accommodation space 31 has a key cut engagement receiver (not shown) engageable with a key cut of the key plate portion 2A. An engagement between the key cut of the key plate portion 2A and the key cut engagement receiver of the accommodation space 31 forms a temporary retaining condition (under a lock release condition described later, the emergency key 2 can be pulled out by force above a certain level).

Figure 2A:
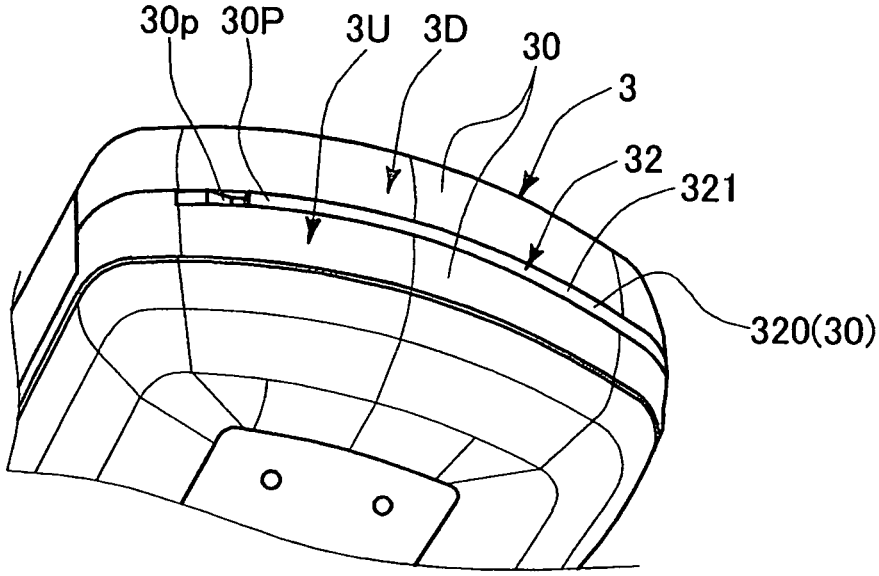
FIGS. 2A and 2B are diagrams for explaining a protrusion action of the portable wireless key of FIG. 1.
Figure 2B:
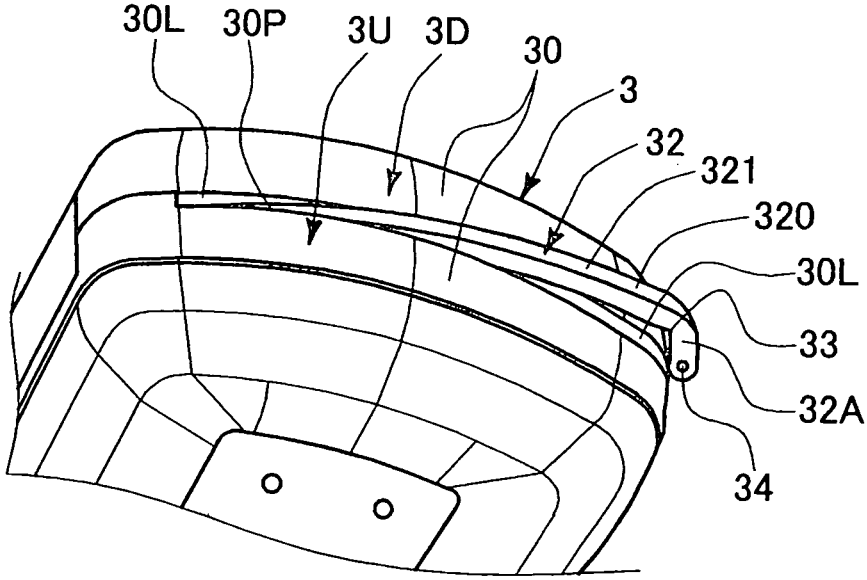

As shown in FIGS. 2A and 2B, the wireless key body 3 is divided into two in its thickness direction. An upper case body 3U and a lower case body 3D are aligned and joined together. An operation section 39 including an operation portion used to lock/unlock the door is located on a main surface of the wireless key body 3. A controller connected to the operation section 39 and a wireless transceiver controlled by the controller are incorporated in the wireless key body 3. Since an electrical configuration of such a portable wireless key 1 is known, an explanation of the electrical configuration is omitted.

By the way, in the portable wireless key 1 according to the present invention, the wireless key body 3 has a protrusion action portion 32 for performing a protrusion action in response to one push to an operation surface 30P. The operation surface 30P is located at a predetermined position on the outer side surface 30 to define the outer side surface 30. The protrusion action causes the protrusion action portion 32 to protrude outward from the wireless key body 3. As a result of the protrusion action, a hook 33 of the protrusion action portion 32 held in the wireless key body 3 is exposed outside and becomes available as a second hook with the emergency key 2 held in the wireless key body 3.

Figure 3A:
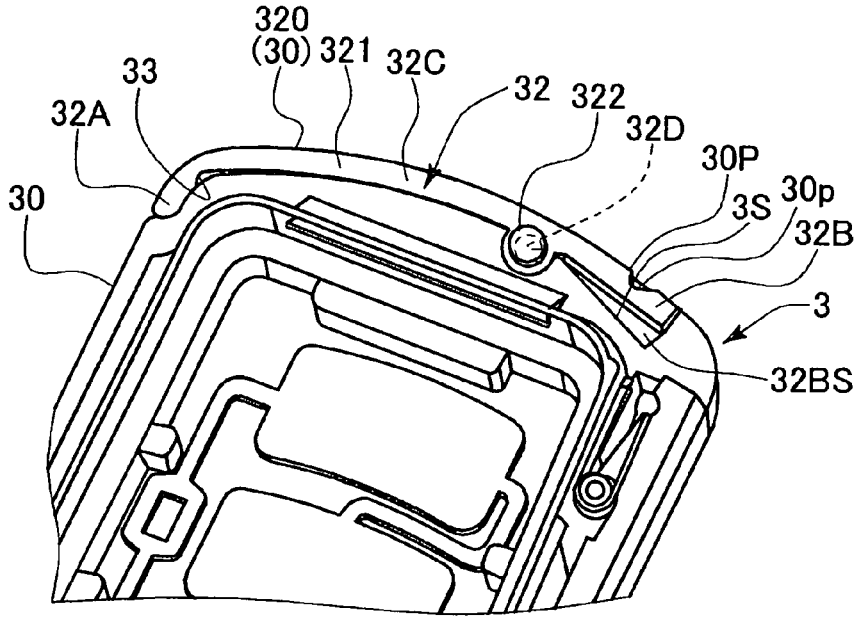
FIGS. 3A and 3B are diagrams illustrating exploded views of FIGS. 2A and 2B, respectively.
Figure 3B:
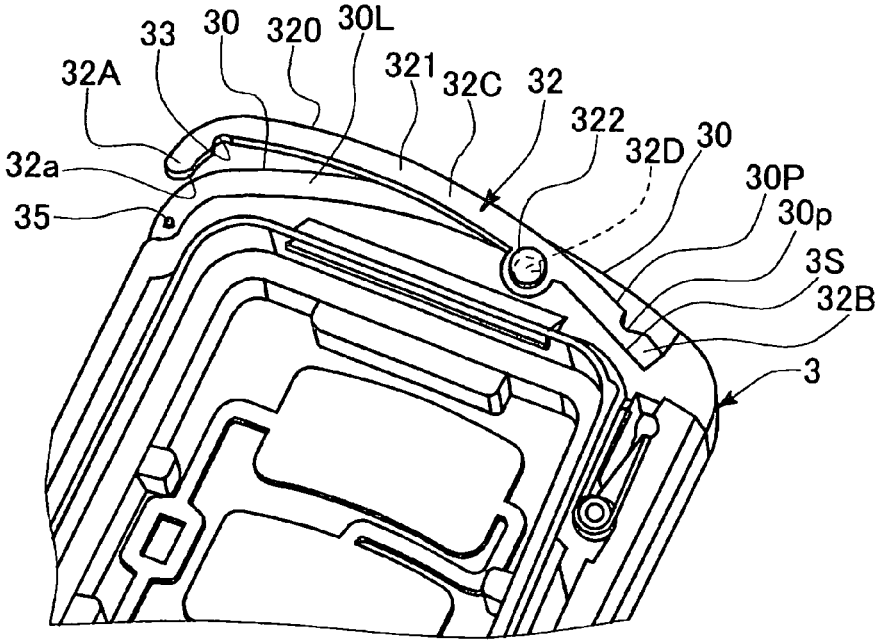

Below, the portable wireless key according to the first embodiment is described in detail with reference to FIGS. 2A, 2B and FIGS. 3A, 3B. FIGS. 2A, 2B are diagrams for explaining the protrusion action of the portable wireless key. FIGS. 3A, 3B are diagrams illustrating exploded views of FIGS. 2A, 2B, respectively.

According to the first embodiment, the protrusion action portion 32 includes a rotation member 321 and a rotation axis member 322 for rotatably fixing the rotation member 321 to the wireless key body 3. The rotation member 321 extends in a direction perpendicular to a rotation axis of the rotation axis member 322 and has end portions 32A and 32B. An engagement receiver 34, engageable with an engagement portion 35 of the wireless key body 3, and the hook 33 are formed at the end portion 32A. The engagement receiver 34 and the engagement portion 35 of the wireless key body 3 are engaged with each other to form an engagement condition that keeps the protrusion action portion 32 held in the wireless key body 3.

The rotation axis member 322 is located between the end portions 32A, 32B and extends in the thickness direction of the wireless key body 3. It is noted that the rotation axis member 322 is located closer to the end portion 32A, where the hook 33 and the engagement receiver 34 are formed, than the end portion 32B.

An outer surface of the end portion 32B, where the hook 33 and the engagement receiver 34 are not formed, is exposed outside from the side of the wireless key body 3 to define the operation surface 30P that can be pushed down toward the inside of the wireless key body 3. When the push to the operation surface 30P is performed, the end portion 32B, where the operation surface 30P is formed, is pushed down toward the inside of the wireless key body 3, and the opposite end portion 32A is moved up toward the outside of the wireless key body 3. When the end portion 32A is moved up toward the outside of the wireless key body 3, the engagement condition between the engagement portion 35 of the wireless key body 3 and the engagement receiver 34 of the end portion 32A is physically released so that the hook 33 can protrude from the inside to the outside of the wireless key body 3. Thus, the hook 33 can catch a hook or the like.

The operation surface 30P is exposed to the outer side surface 30 of the wireless key body 3 in such a manner that the push to the operation surface 30P is allowable by only a special tool (e.g., emergency key 2) having a tip portion narrower than a predetermined width, such as a member (e.g., flathead screwdriver) having a width equal to or less than a width of the key plate portion 2A of the emergency key 2.

The rotation member 321 is a plate member and rotatably fixed by the rotation axis member 322. The rotation axis member 322 is located closer to the inside of the wireless key body 3 than the rotation member 321. A surface 320 of the rotation member 321 on the far side from the rotation axis member 322 defines the outer side surface 30 of the wireless key body 3. The operation surface 30P is a surface of the surface 320 on the end portion 32B-side with respect to the rotation axis member 322. A recess 30*p*, engageable with the tip portion of the special tool (e.g., emergency key 2), is formed on the operation surface 30P. The push to the operation surface 30P is performed by pushing down the bottom of the recess 30*p* with the tip portion of the special tool (e.g., emergency key 2). The push is performed with the tip portion of the special tool received in the recess 30*p*. Thus, the tip portion of the special tool is less likely to slip, so that the push can be easily performed.

An opening 30L is formed in the wireless key body 3. The rotation member 321 is held in the opening 30L in such a manner that the surface 320 is exposed. The opening 30L has a rotation allowable space 32BS for allowing the end portion 32B of the rotation member 321 to rotate toward the inside of the wireless key body 3 in response to the push to the operation surface 30P. The rotation allowable space 32BS is formed as a space between the upper case body 3U and the lower case body 3D. A wall portion (wall surface) 3S is formed inside the wireless key body 3 and defines the rotation allowable space 32BS. The wall portion 3S serves as a movement limiting means for limiting the rotation to a predetermined angle position. In such an approach, the amount of protrusion of the opposite end 32A, where the hook 33 is formed, is kept constant. Thus, an excessive protrusion is prevented so that the hook 33 can protrude by only an amount suitable for catching an object.

According to the present embodiment, the rotation member 321 is L-shaped as a whole. The L-shaped rotation member 321 is rotatably fixed to the rotation axis member 322 at the middle of its longitudinal portion 32C. Specifically, the rotation member 321 is a L-shaped metal plate, and an axis insertion hole 32D is formed at the middle of the longitudinal portion 32C. The rotation axis member 322 is cylindrical and projects from an outer edge portion of the wireless key body 3 in the thickness direction of the wireless key body 3. The rotation axis member 322 is inserted through a flat washer into the axis insertion hole 32D. The axis insertion hole 32D is fixed to a tip portion of the cylindrical rotation axis member 322 by hot swaging so that the axis insertion hole 32D can be undetachable from the rotation axis member 322 and free to rotate (here, slidably rotate) with respect to the rotation axis member 322.

Further, according to the present embodiment, the protrusion action portion 32 covers the opening 30L, which is L-shaped and formed on the outer side surface 30 of the wireless key body 3. The surface 320 of the protrusion action portion 32 is exposed from the opening 30L and flush with the outer side surface 30 of the wireless key body 3 so as to define a part of the outer side surface 30. The L-shaped opening 30L according to the present embodiment is formed on the outer side surface 30 over one corner, out of four, of the wireless key body 3. The L-shaped protrusion action portion 32 is fitted into the L-shaped opening 30L. When the push to the operation surface 30P of the protrusion action portion 32 is performed, a curve portion 33 curved from the longitudinal portion 32C of the protrusion action portion 32 is moved up toward the outside of the wireless key body 3 so that a tip surface (here, a little inner surface of a tip of a curve tip portion 32A) of a curve tip portion 32A curved from the longitudinal portion 32C can reach a position corresponding to an outer edge of the opening of the wireless key body 3. The position is determined by the above movement limiting means. Thus, when the hook 33 catches an object, the object is held in a space between a curved inner surface of the L-shaped protrusion action portion 32 and the outer side surface of the wireless key body 3 facing the inner surface. Therefore, the object is less likely to be detached from the hook 33.

According to the present embodiment, the hook 33 is configured as a curve portion curved from one tip portion of the longitudinal portion 32C of the L-shaped protrusion action portion 32. In other words, the hook 33 is an inner corner portion of the curve portion. The inner corner portion of the curve portion is configured as a recess portion recessed toward an outer corner portion of the curve portion. Thus, the hook 33 can surely catch the object. The recess portion has a curved surface.

According to the present embodiment, the engagement receiver 34 is located at the curve tip portion 32A curved from one tip portion of the longitudinal portion 32C of the L-shaped protrusion action portion 32 and formed as a groove or a hole recessed in the thickness direction of the wireless key body 3. In contrast, the engagement portion 35 of the wireless key body 3, engageable with the engagement receiver 34, is formed as a projection projecting in the thickness direction of the wireless key body 3.

According to the present embodiment, the protrusion action portion 32 is located at an end portion of the short side with respect to a substantially rectangular main surface of the wireless key body 3, which is shaped like a box having a substantially cube shape. More specifically, the protrusion action portion 32 is located at the end portion of the opposite side from which the emergency key 2 is removed. The L-shaped protrusion action portion 32 has the longitudinal portion 32C on the short side of the wireless key body 3 and is curved toward an adjacent long side.

Second Embodiment

Figure 4A:
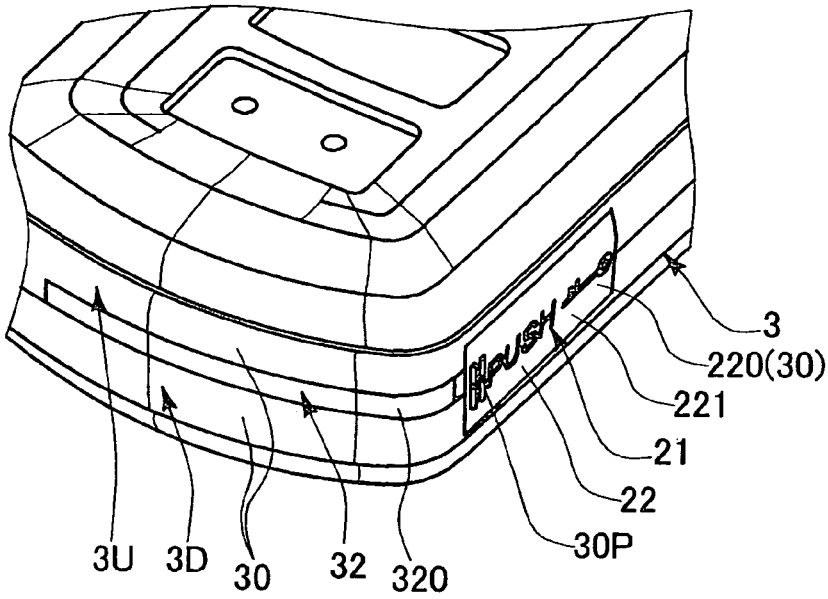
FIGS. 4A and 4B are diagrams for explaining a protrusion action of a portable wireless key according to a second embodiment of the present invention.
Figure 4B:
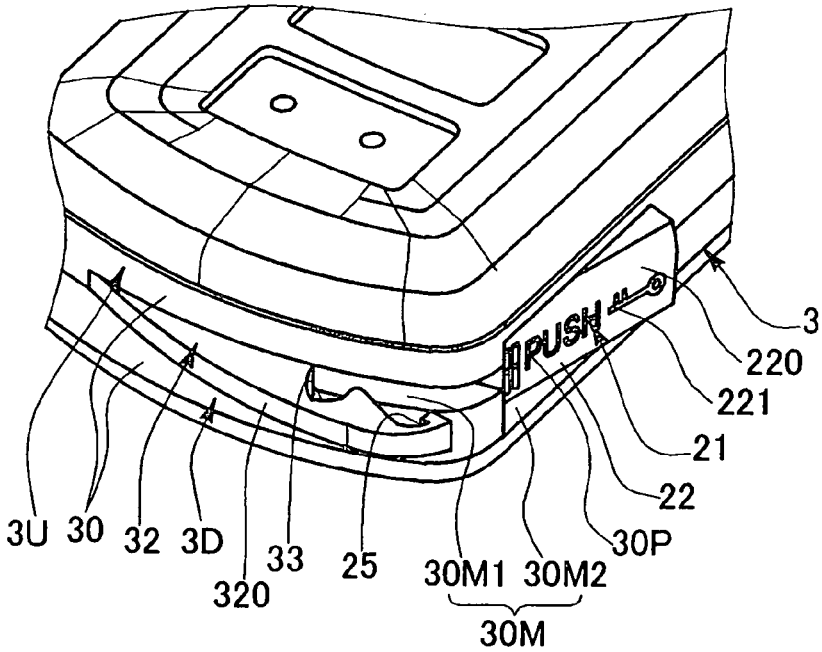
Figure 5A:
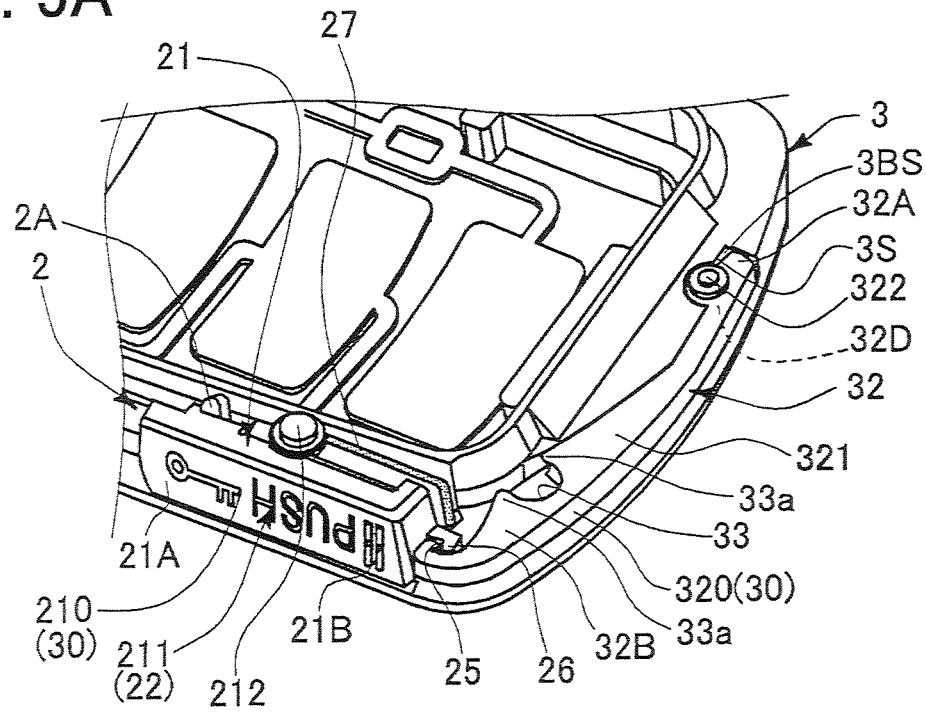
FIGS. 5A and 5B are diagrams illustrating exploded views of FIGS. 4A and 4B, respectively.
Figure 5B:
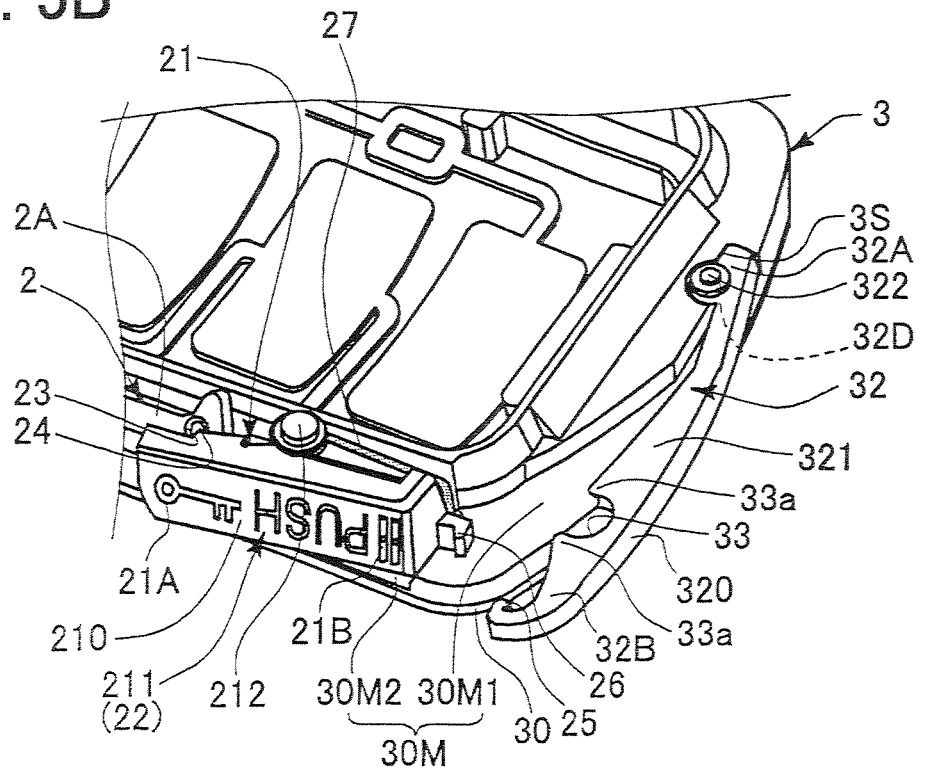

Next, a portable wireless key according to a second embodiment of the present invention is described below with reference to FIGS. 4A, 4B and FIGS. 5A, 5B. FIGS. 4A, 4B are diagrams for explaining a protrusion action of a portable wireless key according to the second embodiment. FIGS. 5A, 5B are diagrams illustrating exploded views of FIGS. 4A, 4B, respectively.

According to the second embodiment, the wireless key body 3 has a lock mechanism 21 for disabling the held emergency key 2 from being removed and a lock release operation portion 22 for releasing the lock mechanism 21. The protrusion action portion 32 performs a protrusion action in response to a lock release action of the lock mechanism 21 so that the hook 33 of the protrusion action portion 32 can become available. Specifically, a lock condition of the lock mechanism 21 is released by one push to a predetermined position of the outer side surface 30 of the wireless key body 3 so that the emergency key 2 can become removable and that the hook 33 of the protrusion action portion 32 can be exposed outside. That is, an operation for causing the lock release action of the lock mechanism 21 causes the protrusion action of the protrusion action portion 32.

It is noted that when the hook 33 of the protrusion action portion 32 is exposed outside as a result of the protrusion action, the lock mechanism 21 can return to the lock condition with the protrusion action portion 32 kept in the protrusion condition. That is, the hook 33 of the protrusion action portion 32 can be available with the emergency key 2 kept in the lock condition.

The lock mechanism 21 of the wireless key body 3 includes a rotation member (movable member) 211 and a rotation axis member 212 for rotatably fixing the rotation member 211 to the wireless key body 3. The rotation member 211 has a first engagement portion 24 and a second engagement portion 26. The first engagement portion 24 is engaged with an engagement receiver 23 of the emergency key 2 held in the wireless key body 3 to form an engagement condition that disables the held emergency key 2 from being removed. The second engagement portion 26 is engaged with an engagement receiver 25 of the protrusion action portion 32 to form an engagement condition that keeps the hook 33 of the protrusion action portion 32 held in the wireless key body 3.

The lock release operation portion 22 releases the engagement conditions of the first engagement portion 24 and the second engagement portion 26 of the lock mechanism 21 at the same time in response to the push, thereby causing the protrusion action for exposing the hook 33 of the protrusion action portion 32 outside. According to the present embodiment, the lock release operation portion 22 corresponds to the rotation member 211.

According to the present embodiment, the rotation member 211 extends in a direction perpendicular to a rotation axis of the rotation axis member 212. The first engagement portion 24 is located at one end portion 21A of the rotation member 211. The second engagement portion 26 is located at the other end portion 21B of the rotation member 211. The rotation member 211 has the operation surface 30P for the push, as the lock release operation portion 22, at the end portion 21B where the second engagement portion 26 is located. When the operation surface 30P is pushed down toward the inside of the wireless key body 3, the end portion 21A, where the first engagement portion 24 is located, is moved up toward the outside of the wireless key body 3 so that the engagement condition between the first engagement portion 24 and the engagement receiver 23 can be released, and the opposite end portion 21B, where the second engagement portion 26 is located, is pushed down toward the inside of the wireless key body 3 so that the engagement condition between the second engagement portion 26 and the engagement receiver 25 can be released. Thus, the protrusion action for exposing the hook 33 of the protrusion action portion 32 held in the wireless key body 3 outside can be caused.

The rotation member 211 is biased and held by a biasing means 27 such a spring so that the first engagement portion 24 and the second engagement portion 26 can be positioned in engagement angle positions where the first engagement portion 24 and the second engagement portion 26 form the respective engagement conditions. The push to the operation surface 30P is applied against the biasing force of the biasing means 27. When the push is removed, the first engagement portion 24 and the second engagement portion 26 return to the respective engagement positions.

The protrusion action portion 32 includes a rotation member 321 and a rotation axis member 322 for rotatably fixing the rotation member 321 to the wireless key body 3. The rotation axis member 322 is located at the end portion 32A of the rotation member 321. The engagement receiver 25, engageable with the second engagement portion 26 of the rotation member 211 of the lock mechanism 21, is located at the opposite end portion 32A. The end portions 32A and 32B are located opposite to each other in the direction perpendicular to the rotation axis of the rotation axis member 322. The end portion 32A is located further away from the lock mechanism 21 than the end portion 32B.

In addition to the key cut, a groove or a hole is formed as the engagement receiver 23 in the emergency key 2. The lock mechanism 21 has a projection fitted with the groove or the hole to form the engagement condition (fitted condition). That is, the projection serves as the first engagement portion 24 engageable with the engagement receiver 23. According to the present embodiment, the emergency key 2 has a through hole 23 as the engagement receiver 23. The through hole 23 is located at the tip portion of the key plate portion 2A and penetrates from the inside to the outside of the wireless key body 3 under a condition that the key plate portion 2A is held in the wireless key body 3. In contrast, the lock mechanism 21 has a projection 24 as the first engagement portion 24. The projection 24 projects from the outside to the inside of the wireless key body 3. Under the lock condition, the projection 24 is inserted through the through hole 23 so that the emergency key 2 cannot be removed. When the end portion 21A of the lock member 211, where the first engagement portion 24 is formed, is moved up toward the outside of the wireless key body 3 by the push to the operation surface 30P on the rotation member 211 of the lock mechanism 21, the projection 24 is removed from the through hole 23. As a result, the lock of the lock mechanism 21 is released so that the emergency key 2 can be removed.

According to the present embodiment, the protrusion action portion 32 of the wireless key body 3 has a craw-like engagement receiver as the engagement receiver 25. The lock mechanism 21 has a craw-like engagement portion as the second engagement portion 26 engageable with the engagement receiver 25. That is, craw portions of the engagement receiver 25 and the engagement portion 26 catch each other and are engaged with each other. Thus, even when the end portions 32A, 32B of the protrusion action portion 32 are pushed down toward the inside of the wireless key body 3, the protrusion action portion 32 does not perform the protrusion action. Specifically, the rotation member 321 of the protrusion action portion 32 and the rotation member 211 of the lock mechanism 21 are arranged in a L-shape. Therefore, when the end portion 32A of the protrusion action portion 32 is pushed, the craw portions of the engagement receiver 25 and the engagement portion 26 are engaged in the extension direction of the rotation member 211 to prevent the opposite end portion 32B from moving up toward the outside of the wireless key body 3. In contrast, when the end portion 32B of the protrusion action portion 32 is pushed, force is applied in the extension direction of the lock mechanism 21 (in other words, in a direction toward the rotation axis member 322 with respect to the rotation member 211). Therefore, the rotation member 211 of the lock mechanism 21 does not move (rotate), and the protrusion action portion 32 does not move (rotate). On the other hand, when the operation surface 30P on the rotation member 211 of the lock mechanism 21 is pushed so that the end portion 21A of the lock mechanism 211, where the second engagement portion 26 is formed, can be pushed down toward the inside of the wireless key body 3, the engagement between the engagement receiver 25 and the engagement portion 26 is released so that the protrusion action for exposing the hook 33 of the protrusion action portion 32 outside can be caused.

According to the present embodiment, the rotation axis member 211 of the lock mechanism 21 is located between the end portions 21A, 21B of the rotation member 211 and extends in the thickness direction of the wireless key body 3. The surface of the rotation member 211 exposed outside the wireless key body 3 on the protrusion action portion 32-side is configured as the operation surface 30P that can be pushed down toward the inside o the wireless key body 3.

According to the present embodiment, the rotation member 211 is a plate member and rotatably fixed by the rotation axis member 212. The rotation axis member 212 is located closer to the inside of the wireless key body 3 than the rotation member 211. A surface 210 of the rotation member 211 on the far side of from the rotation axis member 212 defines the outer side surface 30 of the wireless key body 3. The operation surface 30P is located at the end portion 21B with respect to the rotation axis member 212.

According to the present embodiment, a rotation allowable space 2BS for allowing the end portion 21B of the rotation member 211 of the lock mechanism 21 to rotate toward the inside of the wireless key body 3 in response to the push to the operation surface 30P is formed in the wireless key body 3. A wall portion (wall surface) 2S is formed inside the wireless key body 3 and defines the rotation allowable space 2BS. The wall portion 2S serves as a movement limiting means for limiting the rotation of the rotation member 211 to a predetermined angle position.

According to the present embodiment, a rotation allowable space 3BS for allowing the end portion 32B of the rotation member 321 of the protrusion action portion 32 to rotate is formed in the wireless key body 3. A wall portion (wall surface) 3S is formed inside the wireless key body 3 and defines the rotation allowable space 3BS. The wall portion 3S serves as a movement limiting means for limiting the rotation of the rotation member 321 to a predetermined angle position. In such an approach, the amount of projection of the opposite end 32A, where the hook 33 is formed, is kept constant. Thus, an excessive protrusion is prevented so that the hook 33 can protrude by only an amount suitable for catching an object.

According to the present embodiment, the axis insertion hole 32D is formed at the end portion 32A of the rotation member 321, which is on the far side of the rotation member 321 from the lock mechanism 21. The rotation axis member 322 is cylindrical and projects from the outer edge portion of the wireless key body 3 in the thickness direction of the wireless key body 3. The rotation axis member 322 is inserted through the flat washer in the axis insertion hole 32D, and the tip portion of the rotation axis member 322 is fixed to the axis insertion hole 32D by hot swaging in such a manner that the axis insertion hole 32D (the protrusion action portion 32) is undetachable from the rotation axis member 322 and free to rotate (here, slidably rotate) with respect to the rotation axis member 322.

According to the present embodiment, a recess portion serving as the hook 33 is formed in the protrusion action portion 32. The recess portion is formed at the end portion 32B and located closer to the end portion 32A than the engagement receiver 25. The recess portion is recessed from the inside to the outside of the wireless key body 3. Further, according to the present embodiment, the rotation member 321 of the protrusion action portion 32 covers a long-side opening portion 30M1 of an opening 30L, which is L-shaped and formed on the outer side surface 30 of the wireless key body 3 over one corner. When the operation surface 30P of the protrusion action portion 32 is pushed, the end portion 32B of the rotation member 321 of the protrusion action portion 32 is moved up toward the outside of the wireless key body 3 so that each tip surface 33*a* of the recess portion as the hook 33 facing the inside of the wireless key body 3 can reach a position corresponding to an outer edge of the opening 30M1 of the wireless key body 3. Thus, when the hook 33 catches an object, the object is held in a space between the inner surface (the wireless key body 3-side) of the protrusion action portion 32 and the outer side surface of the wireless key body 3 located facing the inner surface. Therefore, the object is less likely to be detached from the hook 33. It is noted that a short-side opening portion 30M2 is covered by the rotation member 211 of the lock mechanism 21.

According to the present embodiment, the protrusion action portion 32 of the wireless key body 3 is located at an end portion of the short side of the wireless key body 3 with respect to a substantially rectangular main surface of the wireless key body 3, which is shaped like a box having a substantially cube shape. More specifically, the protrusion action portion 32 is located at the end portion of the opposite side from which the emergency key 2 is removed. In contrast, the lock mechanism 21 is located on the long side of the wireless key body 3 where the accommodation space 31 is formed. Specifically, the lock mechanism 21 is located at an end portion of the long side closer to the protrusion action portion 32.

As a result of the push for causing the protrusion action portion 32 to perform the protrusion action, the wireless key body 3 changes from the substantially cube shape to a shape having a projection due to the rotation action (swing action) of the lock mechanism 21. However, when the push is removed, the wireless key body 3 returns to its original shape due to the biasing force of the biasing means 27. Therefore, the operation to the lock mechanism does not spoil a design of the portable wireless key 1.

As described above, according to the first and second embodiments, the portable wireless key 1 has a primary hook (first hook) 2C and a secondary hook (second hook) 33. The primary hook 2C is exposed outside and always available under a condition that the emergency key 2 is held in the wireless key body 3. The secondary hook 33 can be held inside the wireless key body 3. Since the secondary hook 33 can be held inside whenever the secondary hook 33 becomes unnecessary, a design of the portable wireless key 1 is not spoiled. Furthermore, since the secondary hook 33 can be exposed outside by one push whenever the secondary hook 33 becomes necessary, the secondary hook 33 can be easily made available.

The lock mechanism similar to that described in the second embodiment can be added to the first embodiment. In this case, unlike the second embodiment, the lock mechanism can be independent of the protrusion action of the protrusion action portion 32.

Modifications

The above embodiments can be modified in various ways.

For example, in the second embodiment, the engagement receiver 25 of the protrusion action portion 32 can be used as the hook 33. In such an approach, the hook 33 of the second embodiment can be made unnecessary.

What is claimed is:

1. A portable wireless key for locking/unlocking a door of a vehicle by wirelessly communicating with the vehicle, the portable wireless key holding an inserted emergency key inside as a mechanical key for locking/unlocking the door, the portable wireless key comprising:

a body configured to hold the emergency key, wherein the body has an operation surface and a protrusion action portion, the operation surface defines a part of an outer side surface of the body, the protrusion action portion has a hook, one push to the operation surface causes the protrusion action portion to perform a protrusion action, the protrusion action causes the protrusion action portion to protrude outward from inside of the body in such a manner that the hook of the protrusion action portion is exposed outside the body with the emergency key held in the body, the body has a lock mechanism for disabling the held emergency key from being removed from the body and a lock release portion for releasing the lock mechanism, the lock release portion releases the lock mechanism in response to the one push to the operation surface, the emergency key has a first engagement receiver, the protrusion action portion has a second engagement receiver, the lock mechanism includes a movable member having a first engagement portion and a second engagement portion, the first engagement portion of the lock mechanism is engaged with the first engagement receiver of the emergency key held in the body to form a first engagement condition that disables the held emergency key from being removed from the body, the second engagement portion of the lock mechanism is engaged with the second engagement receiver of the protrusion action portion to form a second engagement condition that keeps the hook of the protrusion action portion held in the body, the lock release portion releases the first engagement condition and the second engagement condition at the same time in response to the one push.

2. The portable wireless key according to claim 1, wherein the lock mechanism has a first rotation member serving as the movable member and a first rotation axis member for rotatably fixing the first rotation member to the body, the first engagement portion is located at a first end portion of the first rotation member, the second engagement portion is located at a second end portion of the first rotation member, the first end portion and the second end portion are located opposite to each other in a direction perpendicular to a rotation axis of the first rotation axis member, the operation surface is located at the second end portion of the first rotation member, and the one push releases the second engagement condition by pushing the second end portion of the first rotation member toward the inside of the body and releases the first engagement condition by moving up the first end portion of the first rotation member toward the outside of the body.

3. The portable wireless key according to claim 2, wherein the protrusion action portion has a second rotation member and a second rotation axis member for rotatably fixing the second rotation member to the body, the second rotation axis member is located at a third end portion of the second rotation member, the second engagement receiver is located at a fourth end portion of the second rotation member, the third end portion and the fourth end portion are located opposite to each other in a direction perpendicular to a rotation axis of the second rotation axis member, and the third end portion is located further away from the first rotation member of the lock mechanism than the fourth end portion.

4. The portable wireless key according to claim 1, wherein the emergency key is detachable from a first end portion of the body, and the protrusion action portion protrudes from a second end portion opposite to the first end portion of the body.

5. The portable wireless key according to claim 1, wherein the body is shaped like a box having a substantially cube shape with chamfered corners, and the protrusion action portion is located on the short side of the body with respect to a main surface of the body.

6. The portable wireless key according to claim 1, wherein the emergency key has a hook separate from the hook of the protrusion action portion, and the hook of the emergency key is exposed outside the body under the condition that the emergency key is held in the body.

7. The portable wireless key according to claim 1, wherein the hook and the second engagement receiver of the protrusion action portion are different from each other.

8. A portable wireless key for locking/unlocking a door of a vehicle by wirelessly communicating with the vehicle, the portable wireless key holding an inserted emergency key inside as a mechanical key for locking/unlocking the door, the portable wireless key comprising:

a body configured to hold the emergency key, wherein the body has an operation surface and a protrusion action portion, the operation surface defines a part of an outer side surface of the body, the protrusion action portion has a hook, the body further has a lock mechanism for putting the held emergency key in a lock condition that disables the held emergency key from being removed from the body, one push to the operation surface causes the protrusion action portion to perform a protrusion action, and the protrusion action causes the protrusion action portion to protrude outward from inside of the body in such a manner that the hook of the protrusion action portion is exposed outside the body with the emergency key kept in the lock condition.

9. The portable wireless key according to claim 8, wherein the body has an engagement portion, the protrusion action portion has a rotation member and an rotation axis member for rotatably fixing the rotation member to the body, an engagement receiver is located at a first end portion of the rotation member in a direction perpendicular to a rotation axis of the rotation axis member, and the engagement portion is engaged with the engagement receiver to form an engagement condition that keeps the protrusion action portion held in the body.

10. The portable wireless key according to claim 9, wherein the rotation axis member is located between the first end portion and a second portion of the rotation member, the second end portion is located opposite to the first end portion in the direction, the operation surface is located at the second end portion of the rotation member, the one push pushes the second end portion of the rotation member toward the inside of the body and moves up the first end portion of the rotation member toward the outside of the body, and the operation surface is exposed to the outer side surface of the body in such a manner that the one push to the operation surface is allowable by only a member having a width equal to or less than a width of a key plate portion of the emergency key.

11. The portable wireless key according to claim 8, wherein the emergency key is detachable from a first end portion of the body, and the protrusion action portion protrudes from a second end portion opposite to the first end portion of the body.

12. The portable wireless key according to claim 8, wherein the body is shaped like a box having a substantially cube shape with chamfered corners, and the protrusion action portion is located on the short side of the body with respect to a main surface of the body.

13. The portable wireless key according to claim 8, wherein the emergency key has a hook separate from the hook of the protrusion action portion, and the hook of the emergency key is exposed outside the body under the condition that the emergency key is held in the body.

14. A portable wireless key for locking/unlocking a door of a vehicle by wirelessly communicating with the vehicle, the portable wireless key holding an inserted emergency key inside as a mechanical key for locking/unlocking the door, the portable wireless key comprising:

a body configured to hold the emergency key, wherein the body has an operation surface and a protrusion action portion, the operation surface defines a part of an outer side surface of the body, the protrusion action portion has a hook, one push to the operation surface causes the protrusion action portion to perform a protrusion action, and the protrusion action causes the protrusion action portion to protrude outward from the body in such a manner that the hook of the protrusion action portion is exposed outside the body; wherein an open space is defined between the hook of the protrusion action portion and an outer surface of the body; and the open space is located outside of the body.

15. The portable wireless key according to claim 14, wherein the body has a lock mechanism for disabling the held emergency key from being removed from the body and a lock release portion for releasing the lock mechanism, and the lock release portion releases the lock mechanism in response to the one push to the operation surface.

16. The portable wireless key according to claim 14, wherein the body has an engagement portion, the protrusion action portion has a rotation member and an rotation axis member for rotatably fixing the rotation member to the body, an engagement receiver is located at a first end portion of the rotation member in a direction perpendicular to a rotation axis of the rotation axis member, and the engagement portion is engaged with the engagement receiver to form an engagement condition that keeps the protrusion action portion held in the body.

17. The portable wireless key according to claim 14, wherein the emergency key is detachable from a first end portion of the body, and the protrusion action portion protrudes from a second end portion opposite to the first end portion of the body.

18. The portable wireless key according to claim 14, wherein the body is shaped like a box having a substantially cube shape with chamfered corners, and the protrusion action portion is located on the short side of the body with respect to a main surface of the body.

19. The portable wireless key according to claim 14, wherein the emergency key has a hook separate from the hook of the protrusion action portion, and the hook of the emergency key is exposed outside the body under the condition that the emergency key is held in the body.

20. The portable wireless key according to claim 14, wherein the entire hook of the protrusion action portion is exposed outside the body when the protrusion action is performed.

* * * * *